United States Patent [19]

Sato et al.

[11] Patent Number: 4,721,964

[45] Date of Patent: Jan. 26, 1988

[54] WINDOW ANTENNA FOR A VEHICLE

[75] Inventors: Gentei Sato, Urawa; Haruo Kawakami, Yokohama, both of Japan

[73] Assignee: Nippon Sheet Glass Co., Ltd., Yokohama, Japan

[21] Appl. No.: 906,943

[22] Filed: Sep. 15, 1986

[30] Foreign Application Priority Data

Sep. 21, 1985 [JP] Japan ..... 60-209870

[51] Int. Cl.[4] ..... H01Q 1/32

[52] U.S. Cl. ..... 343/713; 343/711; 343/712

[58] Field of Search ..... 343/711, 712, 713, 793, 343/809, 830, 843, 866

[56] References Cited

U.S. PATENT DOCUMENTS 4,331,961 5/1982 Davis ..... 343/713

FOREIGN PATENT DOCUMENTS 2014643 3/1970 Fed. Rep. of Germany ..... 343/713
2136759 3/1973 Fed. Rep. of Germany ..... 343/713
1417715 12/1975 United Kingdom ..... 343/713

*Primary Examiner*—William L. Sikes
*Assistant Examiner*—Robert E. Wise
*Attorney, Agent, or Firm*—James P. Ryther

[57] ABSTRACT

Disclosed is a window antenna for a vehicle wherein a pair of semiloop antenna elements having a length of λ/2 are branched from a power feed point along a grounded conductor portion in the vertical direction, their terminals are grounded, and the feed point is unbalanced power fed. The antenna has good transmission/reception characteristics in UHF band.

13 Claims, 21 Drawing Figures

(TYPE A)

(TYPE C)

(TYPE E)

WINDOW ANTENNA FOR A VEHICLE

BACKGROUND OF THE INVENTION

1. Field of the Invention

The present invention relates to a window antenna for a vehicle and, more particularly, to a window most suitable for a transmission/reception antenna used for a vehicle telephone or for a personal radio communication set.

2. Description of the Prior Art

Conventionally, a rod antenna arranged on a hood, roof, or trunk is used for a transmission/reception antenna for a vehicle telephone or for a personal radio communication set. Since the transmission band normally used falls in the range of 800 MHz to 900 MHz, a multistep (three to six steps) non-directional colinear rod antenna is often used.

Such a rod antenna is often damaged or stolen. In particular, since the colinear antenna is difficult to have an extendible structure unlike a rod antenna used for reception of radio programs, it cannot be housed in a hood or trunk room when it is not used. When a vehicle mounting the colinear antenna is washed with an automatic car washer, the colinear antenna must be removed.

SUMMARY OF THE INVENTION

The present invention has been made in consideration of the above situation and has as its object to provide a transmission/reception antenna which can provide good characteristics in a UHF band (several hundreds of MHz to several thousands of MHz) by means of a window antenna.

According to the present invention, there is provided a window antenna which is arranged on the window glass of a vehicle and comprises a pair of antenna elements branching from a feed point adjacent to a grounded conductor portion, such as a window frame or a body frame, therealong laterally in both directions. Each antenna element comprises at least one semiloop element of a length of $\lambda/2$ having an opening portion facing the grounded conductor portion. The semiloop element has, e.g., a semicircular shape. The terminals of the antenna elements are grounded and the feed point is provided with unbalance feeding to perform transmisson or reception.

A closed loop antenna is constituted by utilizing the grounded conductor portion, such as a window frame. The window antenna of the present invention occupies a small area although it can provide high performance.

DETAILED DESCRIPTION OF THE PREFERRED EMBODIMENTS

Figure 1:
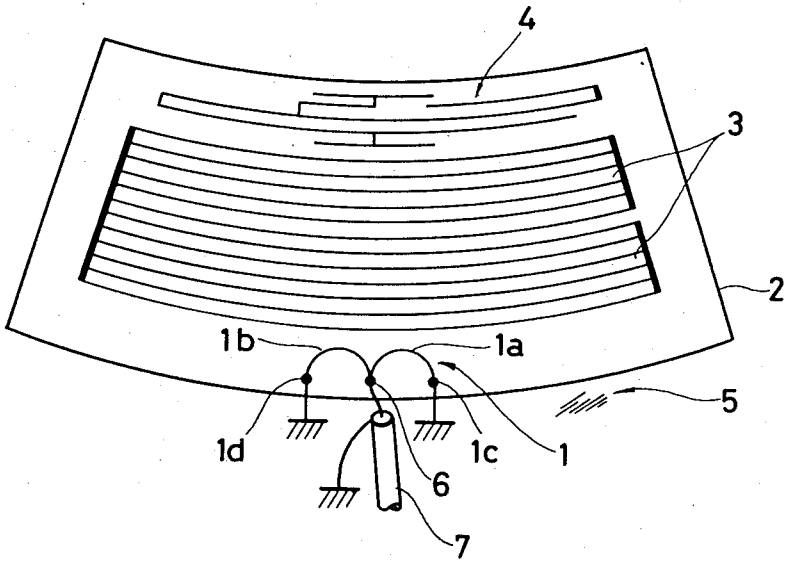
FIG. 1 is a front view of a rear-window antenna comprising a window antenna for a vehicle according to an embodiment of the present invention.

As shown in FIG. 1, a transmission/reception antenna wire 1 used for a vehicle telephone or a personal radio communication set is formed on the inner surface of a rear window glass 2 by printing and baking a conductive paste together with a defogging heater wire 3 and an FM/AM antenna wire 4. The antenna wire 1 is tuned to transmit and receive a vertically polarized wave falling within the range of 800 MHz to 900 MHz with high performance.

Figures 2A, 2B, 2C, 2D, 2E:
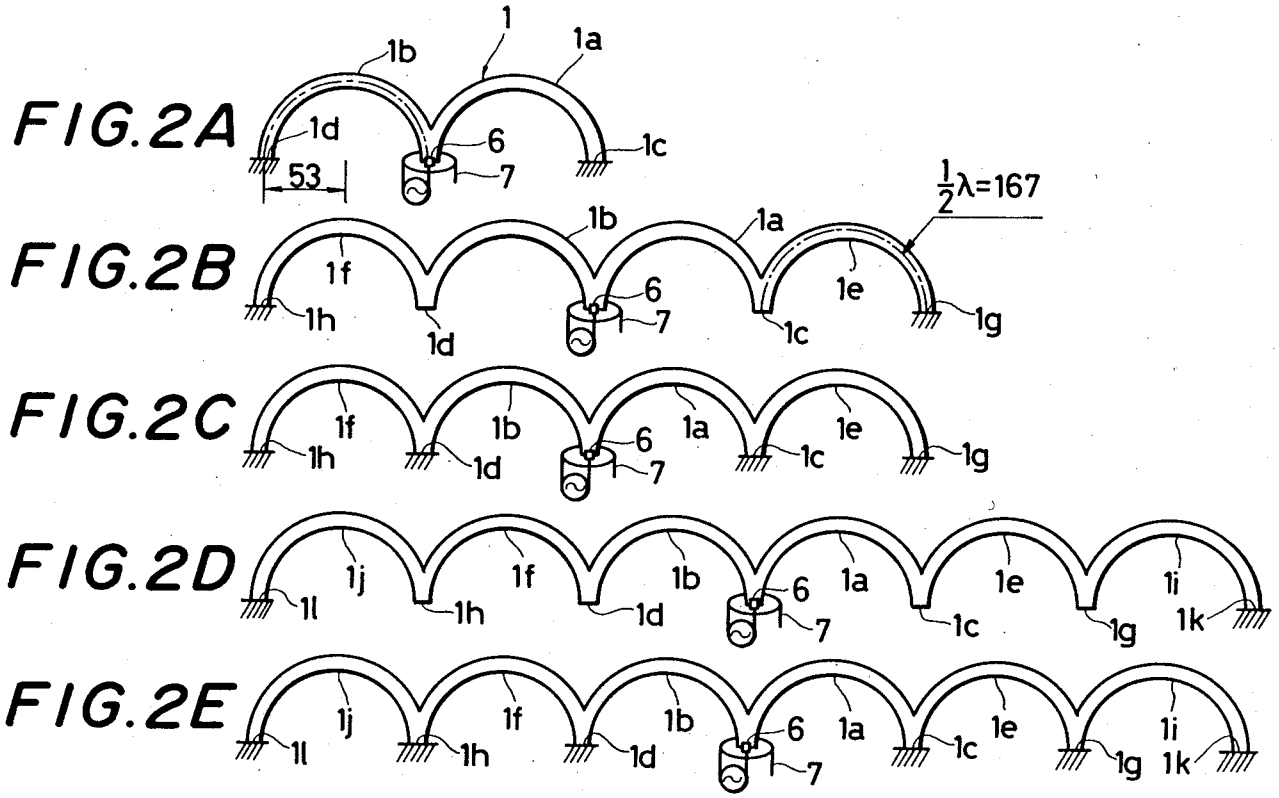
FIG. 2A is a schematic diagram showing a basic arrangement of an antenna pattern.
FIGS. 2B, 2C, 2D, and 2E are schematic diagrams showing modifications of the basic pattern shown in FIG. 2A.

FIG. 2A shows the basic arrangement of an antenna pattern. As shown in FIG. 2A, semicircular semi-loop antenna elements 1*a* and 1*b* are symmetrically branched from a feed point 6, and their terminals 1*c* and 1*d* are grounded. The feed point 6 is unbalanced fed with power by a coaxial feeder 7, whose shield conductor is grounded. The feed point 6 and the terminals 1*c* and 1*d* of the elements 1*a* and 1*b* are arranged substantially in line. As shown in FIG. 1, the entire antenna wire 1 is arranged adjacent to a body frame 5, i.e., a grounded conductor portion of a vehicle along the bottom side (window frame) of the rear window glass 2. The terminals 1*c* and 1*d* are connected to an adjacent frame through a lead wire or a conductive leaf spring.

The length of the semicircular antenna elements 1*a* and 1*b* substantially corresponds to $\lambda/2$. In practice, since a specific band is used for transmission or reception, $\lambda$ is determined so as to correspond to a specific frequency at substantial center within the band while taking a shortening ratio into consideration. In the embodiment in FIG. 2, the specific frequency is 900 MHz, and $\lambda/2$ is 167 mm, and a radius of the semicircular element is 53 mm.

A current fed to the feed point 6 flows through the frame 5 (grounded conductor) from the terminals 1*c* and 1*d* of the elements 1*a* and 1*b* and is then returned to an outer conductor of the coaxial feeder 7. Therefore, assuming that a semicircular image current symmetrical with each of the elements 1*a* and 1*b* flows through the frame, it can be considered that a double-loop antenna, each circumference of which substantially corresponds to a wavelength, is formed. However, since the semicircular conductors are provided in practice, a high-performance loop antenna can be arranged on the window glass with a small occupation area. In particular, since the heater wire 3 and the FM/AM antenna wire 4 are arranged on the rear window glass 2, as shown in FIG. 1, a transmission/reception antenna for a vehicle telephone can be mounted by skillfully using a remaining small area on the glass 2.

Figure 3:
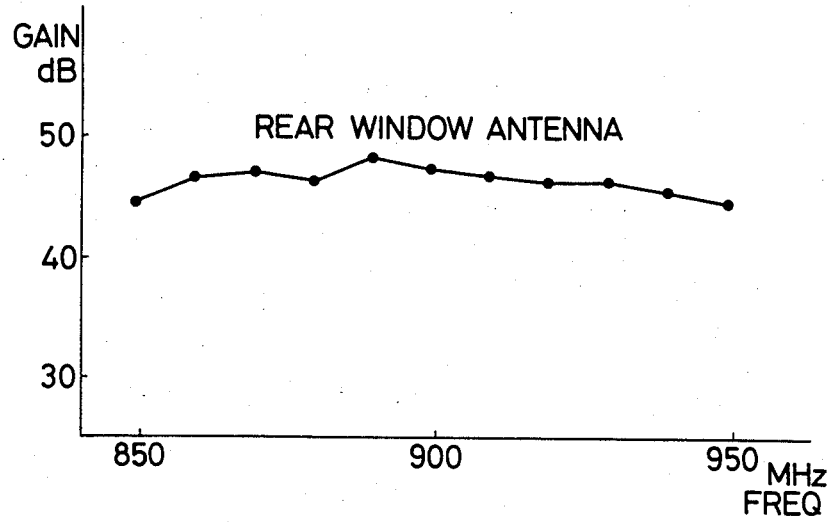
FIG. 3 is a graph showing the frequency-gain characteristics of an antenna wire 1 shown in FIG. 1.
Figure 4:
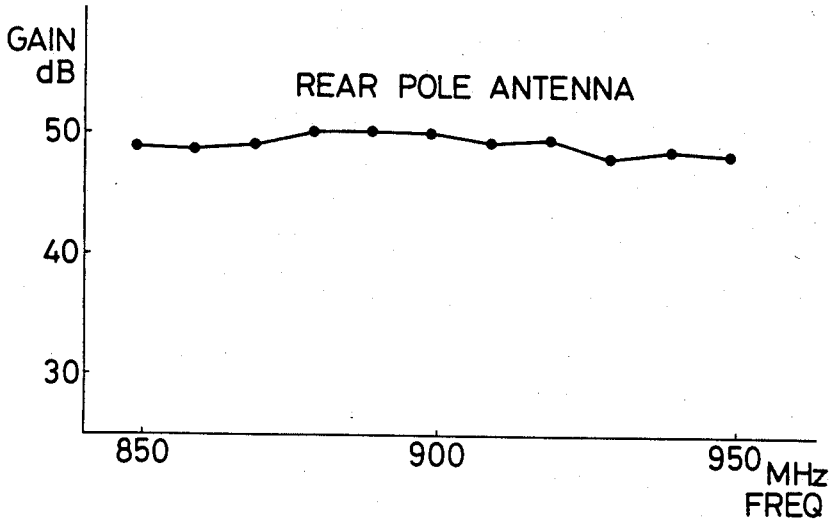
FIG. 4 is a graph showing the frequency-gain characteristics of a conventional rear pole antenna.

FIG. 3 is a reception gain graph of the rear window antenna wire 1 shown in FIG. 1. As can be seen from FIG. 3, substantially flat characteristics can be obtained in the range of 850 MHz to 950 MHz. When compared with a reception gain graph of a conventional rod antenna (rear pole antenna), a decrease in gain of the window antenna of this embodiment is at most 10%.

Figure 5A:
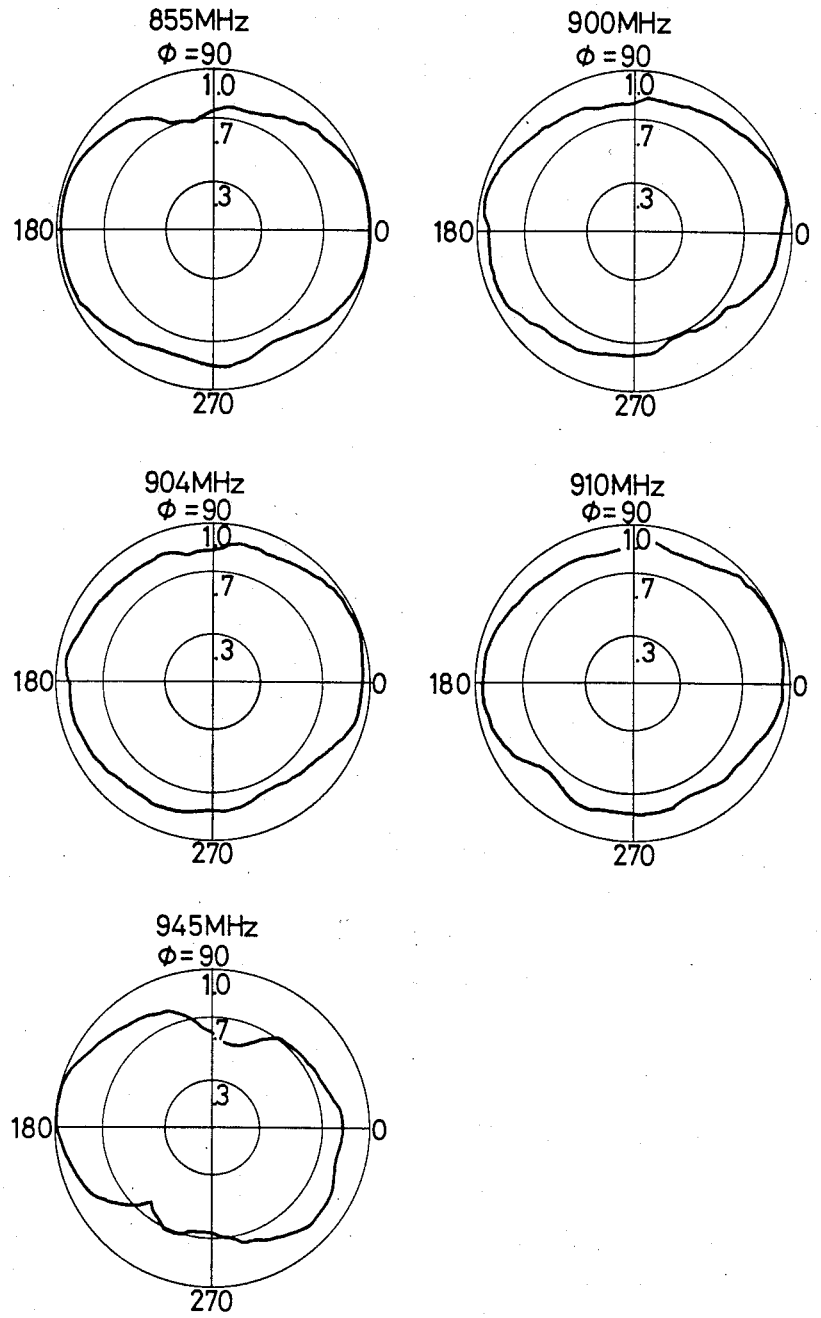
FIGS. 5A, 5B, and 5C are graphs showing directivities corresponding to the antenna patterns shown in FIGS. 2A, 2C, and 2E.

FIG. 5A are directivity graphs of the antenna wire 1 of the basic pattern shown in FIG. 2A made on an experimental basis, wherein gain ratios for the frequencies of 855, 900, 904, 910, and 945 MHz are plotted when maximum gains for azimuth angles 0° to 360° are normarized to 1. As shown in FIG. 5A, nondirectional characteristics having no extreme peak or dip portion can be obtained.

Figure 6A:
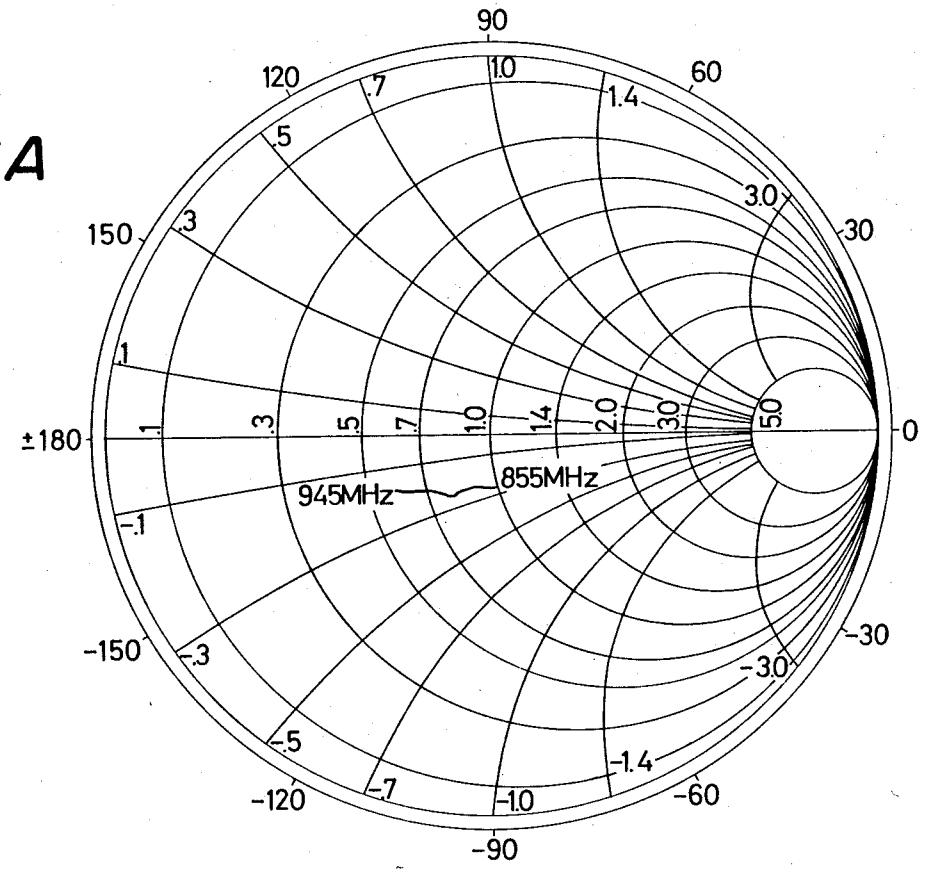
FIGS. 6A, 6B, 6C, 6D and 6E are Smith charts corresponding to FIGS. 2A to 2E.
Figure 6B:
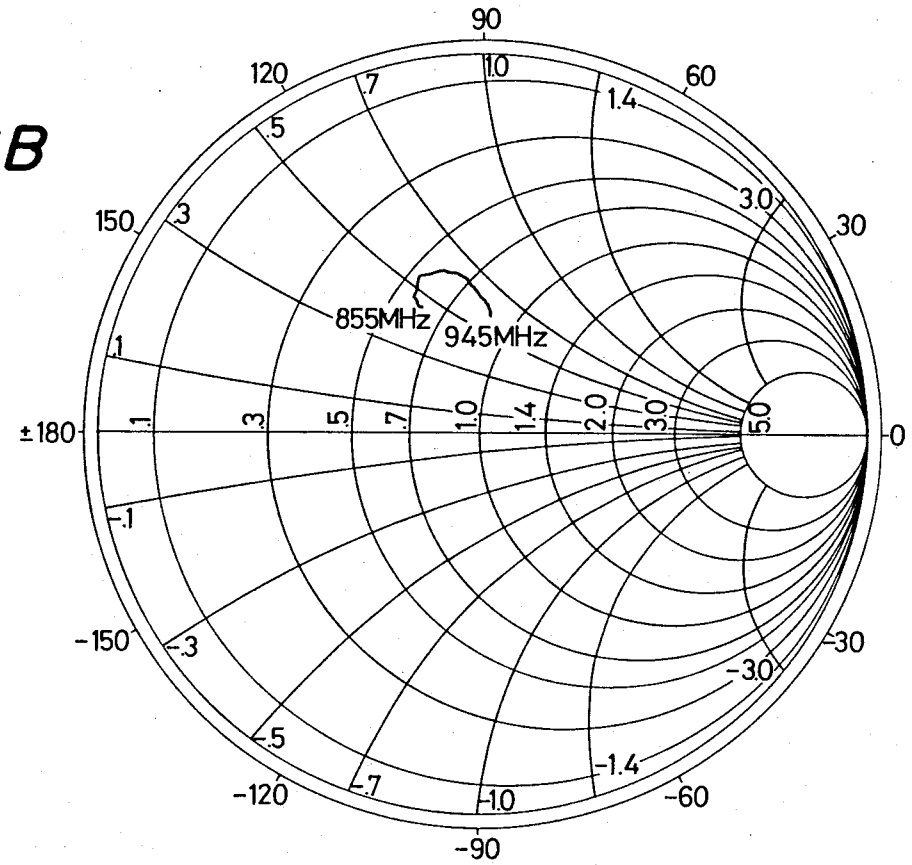
Figure 6C:
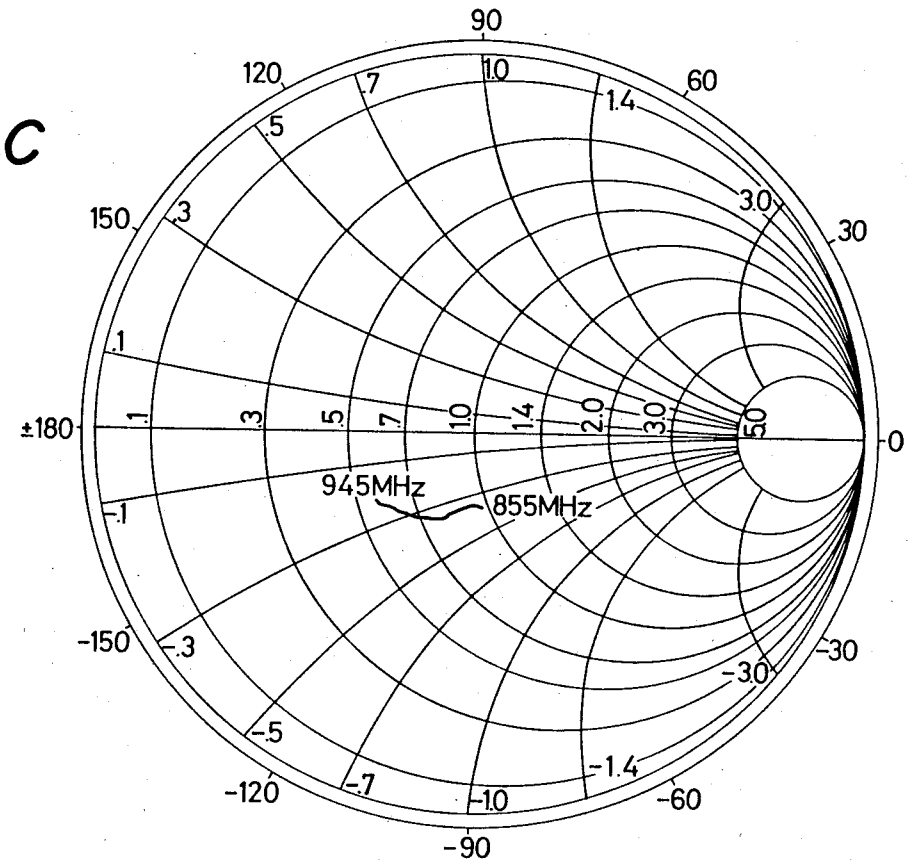
Figure 6D:
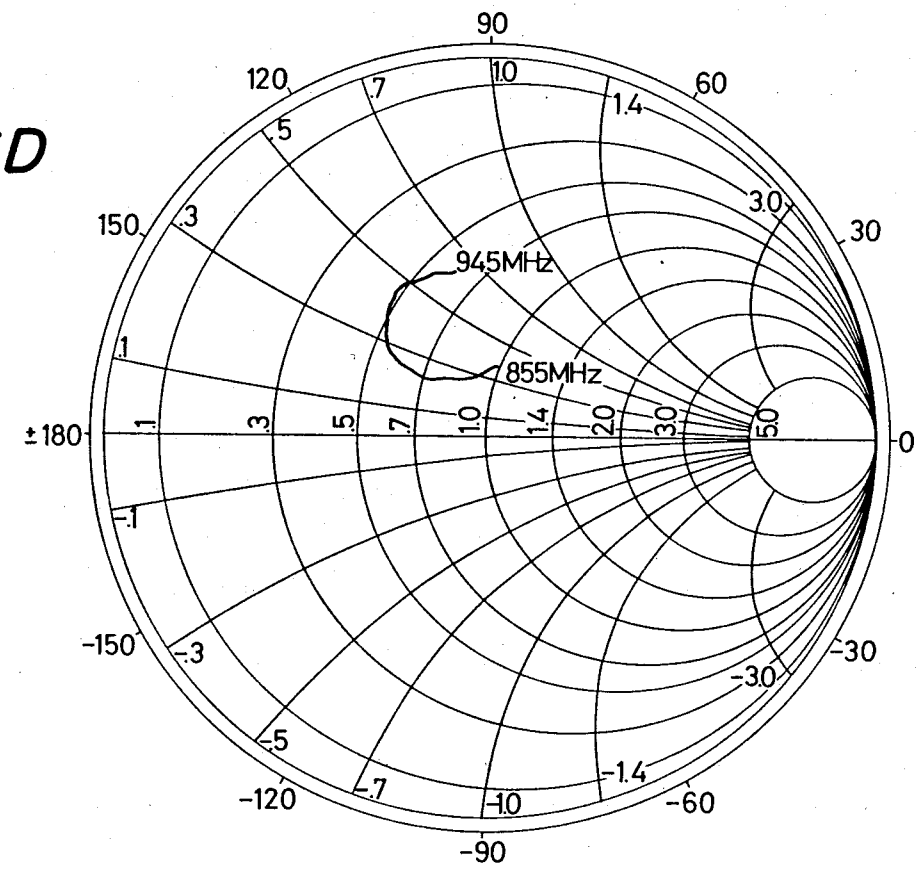
Figure 6E:
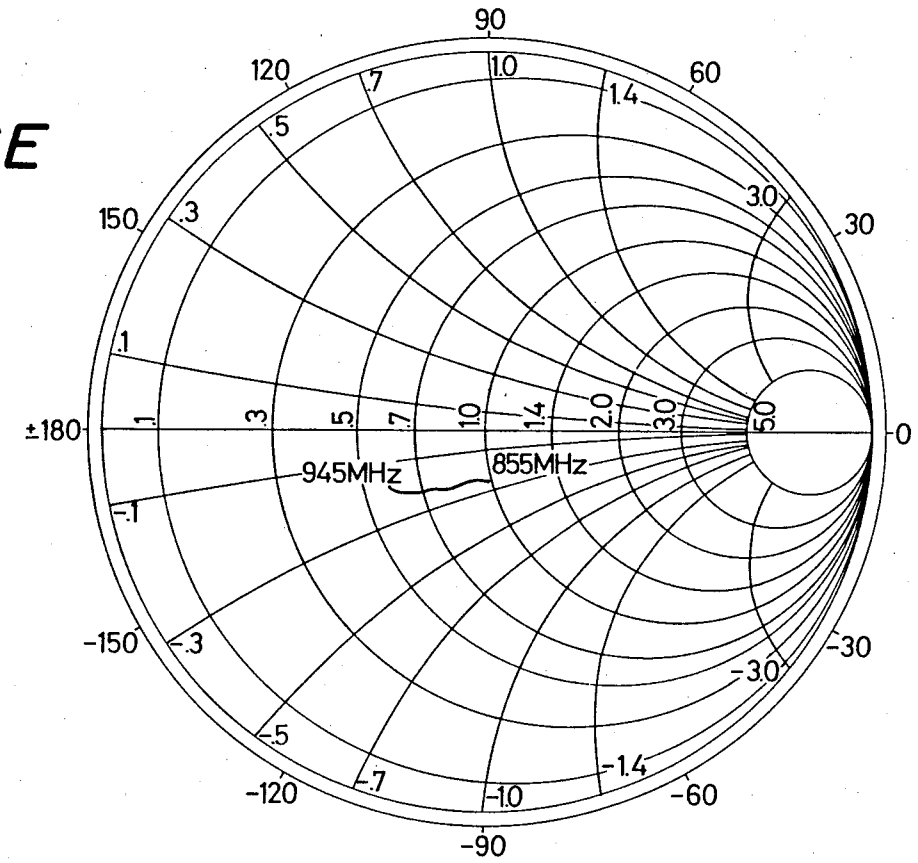

FIG. 6A is a Smith chart of the antenna wire 1 shown in FIG. 2A. As can be seen from FIG. 6A, an impedance very close to a characteristic impedance $Z_0=50\Omega$ (normalized impedance $Z/Z_0=1.0$) can be obtained within the range of 855 to 945 MHz. Therefore, good matching with the feeder 7 is achieved. A change in impedance against a change in frequency is also eliminated.

A standing wave ratio (SWR) falls within a range of 1.2 to 1.7, as shown in the column of Type A in Table 1 below. As can be understood from Table 1, good matching performance can be obtained.

TABLE 1

| Standing Wave Ratio | |
|---|---|
| Antenna Type | SWR |
| A | 1.2 to 1.7 |
| B | 1.9 to 2.5 |
| C | 1.3 to 1.8 |
| D | 1.6 to 3.0 |
| E | 1.2 to 1.7 |

Type A in Table 2 below corresponds to frequency-gain characteristics of the antenna wire of the basic pattern shown in FIG. 2A made on an experimental basis. As can be seen from Table 2, a flat gain can be obtained in the range of 855 to 945 MHz as in the graph shown in FIG. 3. For the purpose of comparison, Table 2 also shows frequency-gain characteristics of a vertical element having a length of λ/4 formed as the window antenna which is provided with unbalanced power feed so as to operate virtually as a λ/2 dipole antenna.

TABLE 2

| | Maximum Gain | | | |
|---|---|---|---|---|
| Antenna | λ/2 Dipole Antenna | Type A | Type C | Type E |
| 855 MHz | 34.6 dB | 40.0 dB | 40.5 dB | 40.5 dB |
| 900 MHz | 37.8 dB | 35.2 dB | 40.0 dB | 39.7 dB |
| 904 MHz | 40.0 dB | 40.1 dB | 43.8 dB | 43.5 dB |
| 910 MHz | 38.8 dB | 39.8 dB | 40.0 dB | 40.5 dB |
| 945 MHz | 33.3 dB | 35.0 dB | 36.4 dB | 35.1 dB |

FIGS. 2B to 2E show the modifications of the basic antenna pattern A. In an antenna of type B, a pair of semicircular elements 1*e* and 1*f* are added to the left and right sides of the antenna of type A, and their terminals 1*g* and 1*h* are grounded. In an antenna of type C, intermediate points 1*c* and 1*d* (nodes) of type B are grounded. In an antenna of type D, semicircular elements 1*i* and 1*j* are added to the antenna of type C, and their terminals 1*k* and 1*l* are grounded. In an antenna of type E, intermediate points 1*c*, 1*d*, 1*g*, and 1*h* are grounded. In these modifications, an antenna conductor length is an even integer-multiple of λ/2.

Figure 5B:
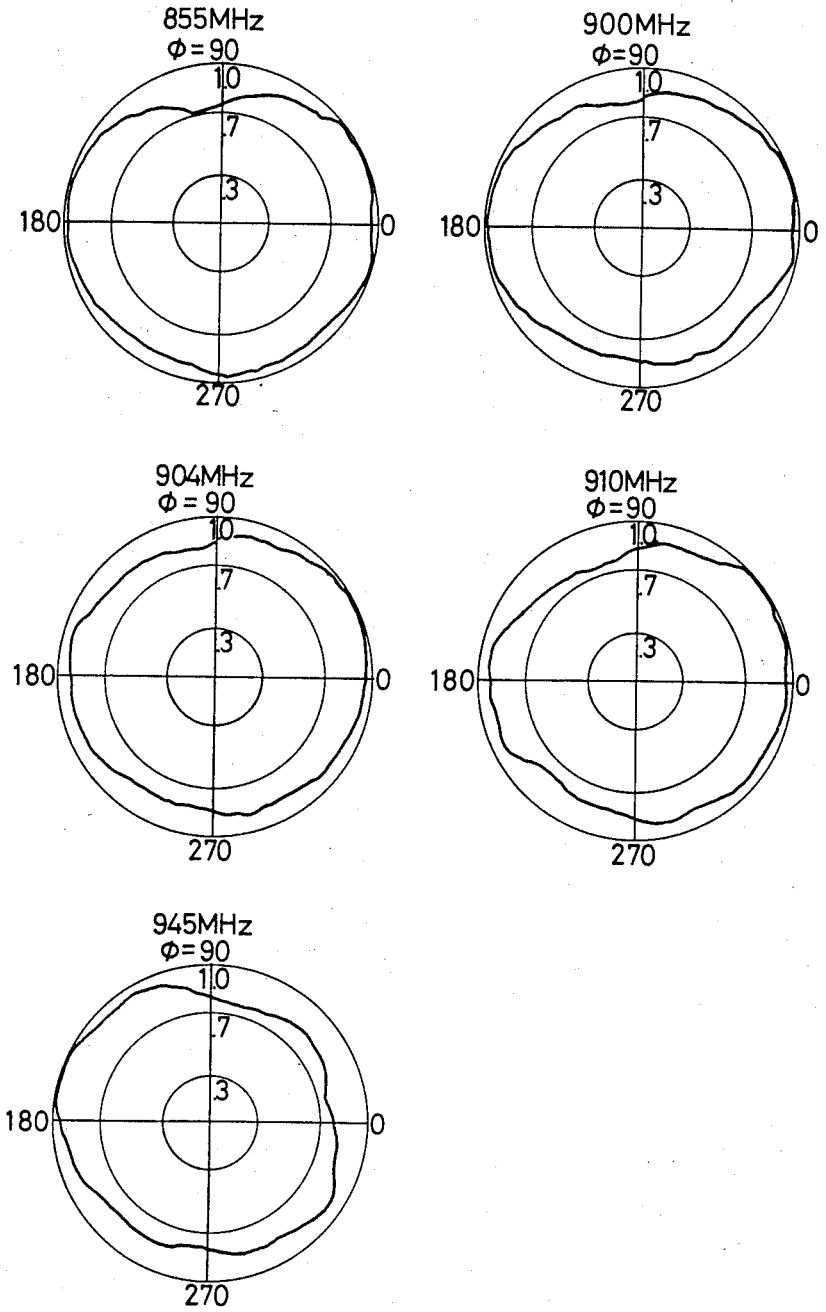
Figure 5C:
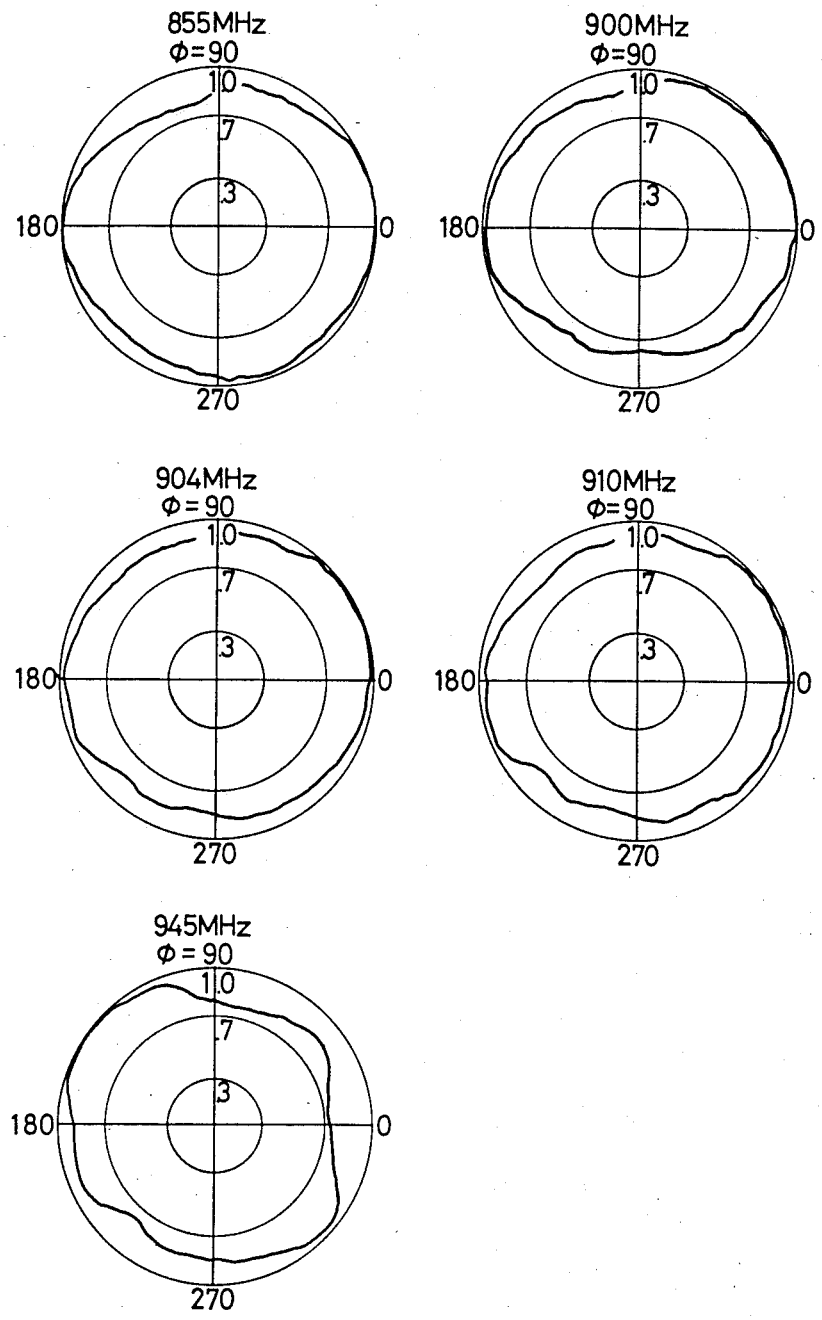

FIGS. 5B and 5C show directivities of the antennas of types C and E, and FIGS. 6B to 6E are Smith charts for the antennas of types B to E shown in FIG. 2. Table 1 shows the standing wave ratios of respective types B to E, and Table 2 shows frequency characteristics of the antennas of types C and E. From these data, the antenna wires of types B to E can provide high performance substantially the same as or superior to that of type A.

Figure 7:
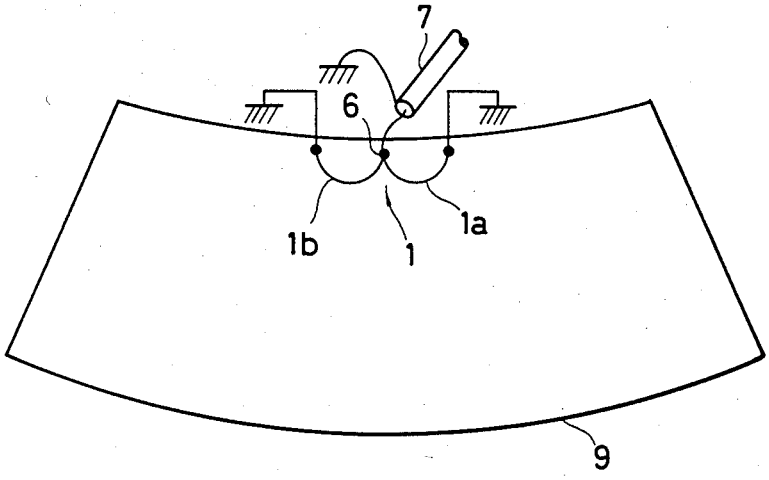
FIGS. 7, 8, 9, 10 and 11 are diagrams showing modifications of antenna locations and antenna shapes.
Figure 8:
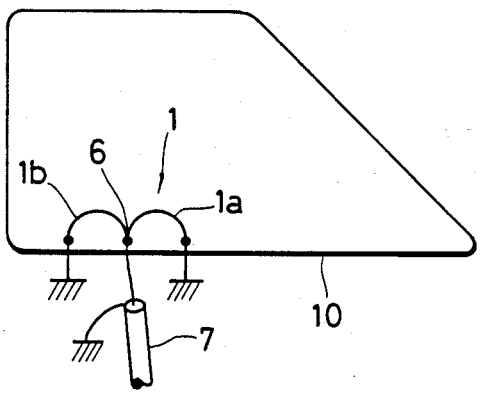

FIG. 7 illustrates a case wherein the antenna wire 1 of type A is added to a front window glass 9 of a vehicle, and is arranged along the upper side of the window glass 9 so as not to interfare with the field of view of a driver. FIG. 8 shows a case wherein the antenna wire 1 is arranged on a rear quarter window 10.

Figure 9:
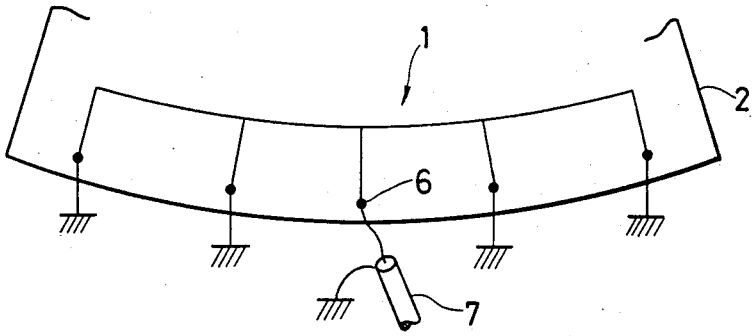

FIG. 9 shows a case wherein each semicircular semiloop shown in FIG. 2 is modified to be a rectangular semiloop. In this case, it is also preferable that the conductor length of the respective rectangular semiloops is set to be about λ/2.

Figure 10:
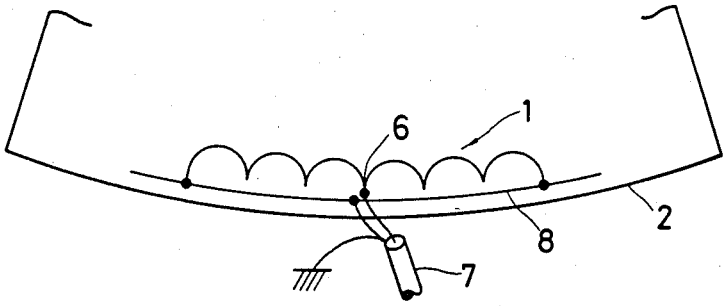

FIG. 10 illustrates a case wherein a ground wire 8 is arranged along the lower portion of the semicircular element array, and the terminals are grounded therethrough. Since grounding of the two terminals and the intermediate points, if necessary, can be achieved by grounding the wire 8 to a point on the frame of to a shield conductor of the coaxial feeder 7, the grounding structure can be simplified.

Figure 11:
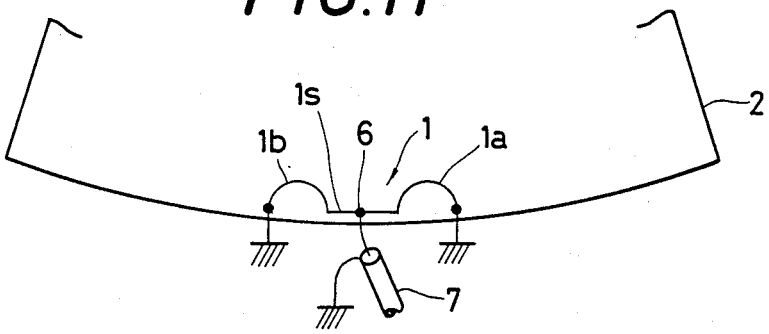

FIG. 11 shows a modification of the basic pattern, in which a pair of semicircular elements 1*a* and 1*b* are separated at a given distance in the horizontal direction. It is preferable that the distance between the two elements (the length of a straight line portion 1*s*) is about λ/2. A plurality of semicircular elements can be added to this modified pattern, as shown in FIGS. 2B to 2E.

In the above embodiments, a pair of antenna elements are symmetrical with each other, but can be asymmetrical by differing the lengths of the respective elements in order to achieve broad-band reception and transmission.

According to the present invention, a high-performance nondirectional transmission or reception antenna for the UHF band having good matching performance with characteristic impedance can be arranged on a window glass of a vehicle with a small occupation area.

What is claimed is:

1. A window antenna arranged on a window glass of a vehicle, comprising:
   - a pair of antenna elements branching from a feed point adjacent to a grounded conductor portion laterally therealong in both directions,
   - each antenna element comprising at least one semiloop element of a length of λ/2 having an opening facing the grounded conductor portion, and
   - terminals of said antenna elements being grounded and said feed point being provided with unbalance feeding.

2. A window antenna according to claim 1, wherein said antenna is a transmission/reception antenna for a vehicle telephone, and has a conductor length tuned in a UHF band.

3. A window antenna according to claim 1, wherein said antenna is arranged on a rear window glass of a vehicle together with a defogging heater wire and a radio reception antenna wire.

4. A window antenna according to claim 1, further comprising an unbalanced power-feed coaxial feeder wire, a core conductor of which is connected to said feed point, and an outer conductor of which is grounded.

5. A window antenna according to claim 1, wherein said semiloop element is a half of a circular loop.

6. A window antenna according to claim 1, wherein the grounded conductor portion is a body of a vehicle.

7. A window antenna according to claim 1, wherein said antenna elements comprise a plurality of series-connected semiloop elements, and terminals of the leftmost and rightmost elements are grounded.

8. A window antenna according to claim 1, wherein said antenna elements comprise a plurality of series-connected semiloop elements, and terminals of the respective elements are grounded.

9. A window antenna according to claim 1, wherein said antenna elements are arranged along an upper side of a front window of a vehicle.

10. A window antenna according to claim 1, wherein said antenna elements are arranged on a rear quarter window of a vehicle.

11. A window antenna according to claim 1, wherein said semiloop element is a half of a rectangular loop.

12. A window antenna according to claim 1, wherein said grounded conductor portion is a grounded conductive wire arranged on a window glass along said antenna elements.

13. A window antenna according to claim 1, further comprising a linear conductor wire having a length of about $\lambda/2$ for connecting said pair of antenna elements at its ends, said feed point being arranged at an intermediate point of said linear conductive wire.

* * * * *